US006379578B1

(12) United States Patent
Shiga

(10) Patent No.: US 6,379,578 B1
(45) Date of Patent: Apr. 30, 2002

(54) WATER-BASED FOAM FIRE EXTINGUISHER

(75) Inventor: Hiroshi Shiga, Chigasaki (JP)

(73) Assignee: GTL Co., Ltd., Chigasaki (JP)

( * ) Notice: Subject to any disclaimer, the term of this patent is extended or adjusted under 35 U.S.C. 154(b) by 0 days.

(21) Appl. No.: 09/529,552

(22) PCT Filed: Aug. 16, 1999

(86) PCT No.: PCT/JP99/04409

§ 371 Date: Apr. 14, 2000

§ 102(e) Date: Apr. 14, 2000

(87) PCT Pub. No.: WO00/09215

PCT Pub. Date: Feb. 24, 2000

(30) Foreign Application Priority Data

Aug. 14, 1998 (JP) ..... 10-229820

(51) Int. Cl.[7] ..... A62D 1/02; A62D 1/04

(52) U.S. Cl. ..... 252/3; 252/8.05; 106/18.13; 106/18.21; 106/18.24

(58) Field of Search ..... 252/2, 3, 8.05, 252/77, 79; 510/123, 126, 477, 478, 480, 490, 502; 106/18.13, 18.21, 18.24, 18.3, 18.32, 18.35

(56) References Cited

U.S. PATENT DOCUMENTS

| | | | | |
|---|---|---|---|---|
| 4,705,893 A | * | 11/1987 | Sotoya et al. | 562/564 |
| 4,876,034 A | * | 10/1989 | Hirota et al. | |
| 4,885,112 A | * | 12/1989 | Sotoya et al. | 562/564 |
| 5,077,041 A | * | 12/1991 | Yamashina et al. | 424/70 |
| 5,085,786 A | * | 2/1992 | Alm et al. | 252/8.05 |
| 5,207,932 A | * | 5/1993 | Norman et al. | 252/3 |
| 5,712,232 A | * | 1/1998 | Moriyama et al. | 510/120 |
| 5,858,936 A | * | 1/1999 | Yamura et al. | 510/131 |
| 5,997,758 A | * | 12/1999 | Barbarin et al. | 252/3 |

FOREIGN PATENT DOCUMENTS

| | | |
|---|---|---|
| JP | 4-24032 | 1/1992 |
| JP | 2860311 | 1/1992 |
| JP | 6-2166 | 1/1994 |
| JP | 6-2169 | 1/1994 |
| JP | 6-218075 | 8/1994 |
| JP | 6-312030 | 10/1994 |
| JP | 8-269481 | 10/1996 |
| JP | 9-124884 | 5/1997 |
| JP | 9-173498 | 8/1997 |

* cited by examiner

*Primary Examiner*—Joseph D. Anthony
(74) *Attorney, Agent, or Firm*—Armstrong, Westerman & Hattori, LLP

(57) ABSTRACT

A water-based foam fire extinguisher excellent in foaming properties and film-forming properties in a low temperature region which includes an aqueous solution of at least one member selected among potassium hydrogen carbonate, ammonium phosphate, ammonium sulfate, ammonium bromide, boron oxide, and potassium tetraborate and, incorporated in the solution, a freezing point depressant so as to have a freezing point of −20° C. or below, characterized by containing a perfluoroalkylbetaine as a fluorochemical surfactant and one or more amide-amino acid type surfactants represented by general formula (1) and/or (2)

(1)

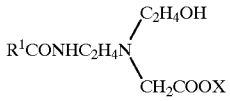

(2)

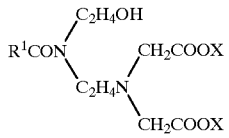

(wherein $R^1$ represents $C_{7-23}$ alkyl, hydroxyalkyl, aralkyl, or alkenyl; and X represents an alkali metal or hydrogen) as hydrocarbon surfactants.

13 Claims, No Drawings

WATER-BASED FOAM FIRE EXTINGUISHER

FIELD OF THE INVENTION

The present invention relates to an aqueous film-foaming foamable fire extinguishing agent (fire foam) which provides excellent foaming power and film-forming properties in a low temperature range, especially an environment at −20° C. or below, further a temperature range at −25° C. or below.

RELATED ART

Conventionally, enhanced potassium carbonate and potassium hydrogen carbonate aqueous solutions are widely known as aqueous fire extinguishing agents. Such fire extinguishing agents extinguish fire with cooling and moisture (wetting)-permeability effects of water. They effectively prevent re-start of fire and provide a clear view to an operator during fire extinguishing. However, although the composition of such aqueous fire extinguishing agents excellently extinguish wood fire, these are said to be less effective to oil fires compared to powder fire extinguishing agents. Further, the above aqueous fire foams are strongly alkaline such that they are not very safe to humans and other animals.

Therefore, the inventor of the present invention previously invented a neutral fire extinguishing agent using ammonium phosphate (Japanese Patent No. 2,860,311).

Fire foams are mainly divided into ones for general oil fires, such as petroleum, gasoline, kerosene and the like, and ones of anti-alcohol type against fires of alcohols, ketones and the like. They include protein fire foams, synthetic surfactant fire foams and aqueous film fire foams.

To extinguish hydrocarbon fires, one suggests a fire extinguishing agent in which a thixotropic solution is formed by adding water-soluble polymers to a foam-film-forming condensate, which is made of a mixture of fluorinated surfactant, a hydrocarbon surfactant and foam-stabilizing solvent of the glycol group, or a fluorinated surfactant.

Japanese Examined Publication H6-2166 discloses an aerosol fire extinguisher using a fire extinguishing agent formed of potassium carbonate, a fluorinated surfactant and an aqueous solution of an anti-freezing agent. To improve the foaming power, the above publication also suggests to add lauryl alcohol sulfate ester, polyoxyethylene lauryl sulfate and the like as a hydrocarbon surfactant.

Japanese Examined Publication H6-2169 discloses an aqueous fire foam containing cationic water-soluble polymers, a polybasic acid, a metal salt having ionic valence of 2 or higher, and a surfactant containing an anionic hydrophilic group; one of embodiments of such a fire foam shows the solidifying point between −14° C. and −23° C.

Japanese Laid-open Publication H6-312030 discloses a water spray portable fire extinguishing agent containing fluorinated betaine, fluorinated amine oxide, alkyl glucoside, a non-fluorinated surfactant, monoalkyl ether of mono- or diethylene glycol; one of embodiments of such a fire extinguishing agent shows the freezing point of −22° C.±2° C.

Japanese Laid-open Publication H9-173498 discloses a fire foam in which a fluorinated surfactant expressed in a specific general formula is added to a synthetic surfactant fire foam.

Japanese Laid-open Publication H9-124884 discloses a foam condensate as an aqueous dispersed solution formed of water-insoluble fluorinated copolymers for fires of polar solutions such as alcohol and the like, a hydrocarbon surfactant, a fluorinated surfactant, and hydrophilic organic solvent.

Ammonium phosphate in the above fire extinguishing agent disclosed in Japanese Laid-open Publication H4-24032 is highly water-soluble wherein its aqueous solution indicates almost neutral pH (6.5 to 8); therefore, it is believed to be an excellent neutral fire extinguishing agent. However, a Japanese regulation requires a fire extinguishing agent to be usable at −20° C.; hence, the above fire extinguishing agent requires addition of a large amount of an anti-freezing agent and a solidifying point lowering agent.

Some of the anti-freezing agents and solidifying point lowering agents are hazardous substances such as class 4 secondary petroleum and tertiary petroleum compounds. Within a range of temperatures for the use of fire extinguishing agents required by the regulation between −20° C. and 40° C., the above fire extinguishing agent may result in volatilization and ignition at a high temperature while performance of the surfactant is lowered at a low temperature resulting in lowered foaming power and film-forming properties. This issue is a notable technological drawback.

As a result, the inventor of the present invention, considering the above issues, invented an aqueous fire foam which has excellent foaming power and film-forming properties at −20° C. or below, especially −25° C. or below (Japanese Laid-open Publication H6-218075). This invention disclosed in Japanese Laid-open Publication H6-218075 relates to an aqueous fire foam of pH 7.4 to 8 (at 20° C.) which has improved foaming power and film-forming properties in a low temperature range wherein an aqueous solution containing a solidifying point lowering agent, and at least one of potassium hydrogen carbonate and ammonium phosphate, added perfluoroalkyl betaine, and one of the following hydrocarbon surfactants: imidazolinium betaine; alkyl carboxyl betaine, N-acyl-N-methyl-β-alaninate as foaming and film-forming agent.

DESCRIPTION OF THE INVENTION (Problems to be Solved)

An aqueous fire foam of the invention disclosed in Japanese Laid-open Publication H6-218075 is composed of a given composition such that the amount of a solidifying point lowering agent added is less than in a conventional one to improve the foaming power and film-forming properties in a low temperature range. However, the market demands an aqueous fire foam which is even more stable in a low-temperature range and which is applicable to both wood fires and oil fires.

(Means to Solve the Problems)

The inventor of the present invention discovered that the foaming power and film-forming properties in a low temperature range of an aqueous fire extinguishing agent can be dramatically improved by the following method. Such an aqueous fire extinguishing agent is formed by adding a solidifying point lowering agent to a solution containing at least one of the following to establish a solidifying point below −20° C.: potassium hydrogen carbonate; ammonium phosphate; ammonium sulfate; ammonium bromide; boron oxide; and potassium tetraborate. The following are also added together to such an aqueous fire extinguishing agent:

perfluoroalkyl betaine as a fluorinated surfactant; and amide amino acid surfactant expressed by the below general formulas (1) and/or (2) (in the formulas: $R^1$ indicates an alkyl group having 7 to 23 carbons, a hydroxy alkyl group, an aralkyl group, or an alkenyl group; and X indicates an alkali metal or hydrogen atom) or a surfactant composition in which alkaline earth metal ions are added to the above surfactant as a hydrogen carbonate surfactant.

(1)

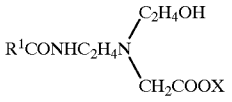

(2)

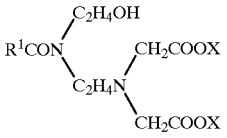

Ordinary surfactants tend to lose a function as an activator at about −10° C. or below, and, they show significantly deteriorated foaming power or even do not foam at all in a low temperature range (−20° C. or below). However, the foaming power can be improved in the low temperature range (−15° C. to −25° C.) by using perfluoroalkyl betaine and an amide amino acid surfactant which is expressed by the above general formulas (1) and/or (2) or a surfactant composition in which alkaline earth metal ions are added to the above surfactant. Also, such surfactants have the effect of promoting saponification in fatty acid ( dietary oil) fires.

At least one of the following is appropriate as a main component (of the aqueous fire foam of the present invention): potassium hydrogen carbonate; ammonium phosphate; ammonium bromide; boron oxide; and potassium tetraborate.

Ethylene glycol is one of widely adapted solidification point lowering agents. All solidification point lowering agents are combustible organic substances; the amount of the agent added must be minimal to prevent re-start of a fire. A preferable amount added is 10 to 20 weight %, more preferably 12 to 18 weight %, in the case of ethylene glycol. Additionally, one may add a supplementary solidification point lowering agent formed of a neutral salt such as urea and ammonium acetate.

For the aqueous fire foam of the present invention, one of the most preferable base solutions comprises 0.2 to 0.5 weight % of perfluoroalkyl betaine and 1.5 to 5 weight % of a surfactant composition containing alkaline earth metal ions to an amide amino acid surfactant expressed by general formulas (1) and/or (2). Perfluoroalkyl betaine mainly functions as a foam developing agent. The amide amino acid surfactant expressed by general formulas (1) and/or (2) mainly functions as a foaming agent.

Base components of the aqueous fire foam of the present invention (by weight %) are as follows; such an aqueous fire foam is formed of the below described base solution itself (concentrate) or by diluting the base solution with water to 3%. The preferable temperature range of use is +40 to −20° C.

| | | |
|---|---|---|
| main fire extinguishing agent: | inorganic salts | 4 to 20 |
| solidification point lowering agent: | ethylene glycol | 10 to 20 |
| foam developing agent: | perfluoroalkyl betaine | 0.2 to 0.5 |

-continued

| | | |
|---|---|---|
| foaming agent: | a surfactant composition in which alkaline earth metal ions are added to an amide amino acid surfactant expressed by general formulas (1) and/or (2) | 1.5 to 5 |
| water: | | remainder. |

The base solution for the aqueous fire foam of the present invention has a specific gravity of 1.13 to 1.15 and pH of about 6.8 to 8.5. One may add the following to the above base components: 3 to 6 weight % of a supplementary fire extinguishing agent; 0.5 to 4 weight % of a supplementary solidification point lowering agent; other supplementary foam developing agents; and a supplementary foaming agent.

Also, one may add a performance improving agent and a pH adjusting agent to the aqueous fire foam of the present invention to improve the performance thereof. The performance improving agent includes a surface tension/interfacial tension reducing agent, condition stabilizing (clarifying) agent, heat-resistance/liquid-resistance improving agent, fine foam forming agent, foam stabilizing agent and rust preventive.

<<Selection of Inorganic Salts>>

The following inorganic salts in general can be used as a main component or a supplement in the aqueous fire foam: silicates; carbonates; borates; and ammonium sulfate. After various trials on the above listed inorganic salts, it is concluded that the following are preferable for a fire extinguishing agent which is stable as an aqueous solution with low-temperature-resistant properties and which is effective to A-class fire (wood) and B-class fire (oil): potassium hydrogen carbonate; ammonium phosphate; ammonium sulfate; ammonium bromide; boron oxide; and potassium tetraborate. A preferable amount to be added is 4 to 20 weight %. When the amount added is less than 4 weight %, a desired result is not obtained; when the amount added is more than 20 weight %, the result does not show any improvement.

Further, supplementary fire extinguishing agents, which can be added to an inorganic salt of the main component, include inorganic compounds, such as silicates, carbonates and ammonium sulfate, or organic compounds. A preferable amount to be added thereof is 3 to 6 weight %. When the amount to be added exceeds 6 weight %, no improvement is observed in the result.

<<Solidifying Point Lowering Agent>>

The following can be used as a solidifying point lowering agent:

- alcohols: methanol; ethanol; isopropyl alcohol;
- polyhydric alcohols: ethylene glycol; propylene glycol; PEG (300); mannitol; glycerin;
- amides: formamide; methyl formamide; acetoamide; methyl acetoamide; dimethyl acetoamide;
- cellosolves: methyl cellosolve; ethyl cellosolve; butyl cellosolve;
- carbitols: diethylene glycol monobuthyl ether; diethylene glycol monoethyl ether;
- others: propylene glycol; ethylene carbonate; propylene carbonate;
- dimethyl sulfoxide; acetonitrile.

All solidifying point lowering agents are combustible organic substances; the amount of the agent added must be minimal to prevent re-start of a fire. A preferable amount added is 10 to 20 weight %, more preferably 14 to 18 weight %. When the amount to be added is less than 10 weight %, the solidifying point is not sufficiently lowered. When the amount exceeds 20 weight %, an appropriate effect of lowering the solidifying point is not obtained, and a possibility of re-start of a fire increases. One may add 0.5 to 4 weight % of a supplementary solidifying point lowering agent, which is formed of a neutral salt such as urea, depending on the need. When the amount to be added exceeds 4 weight %, no improvement is observed in the result.

<<Surfactant>>

The following are fluorinated surfactants usually used as a foam developing agent: perfluoroalkyl carboxylate; perfluoroalkyl sulfonate; perfluoroalkyl quaternary ammonium; perfluoroalkyl poly (oxyethylene); perfluoroalkyl betaine; and perfluoroalkyl amine.

According to the present invention, it is observed that an aqueous fire foam, which has excellent foaming power and film-forming properties in a low temperature range less than −20° C., can be obtained by using perfluoroalkyl betaine among the above fluorinated surfactants and an amide amino acid surfactant expressed by general formulas (1) and/or (2).

An amide amino acid surfactant, which is expressed by general formulas (1) and/or (2) or a surfactant composition, in which alkaline earth metal ions are added to the above amide amino acid surfactant, and which are found to be preferable as a hydrocarbon surfactant for an aqueous fire foam of the present invention are commercially available; they are used in hair/body soap (Japanese Laid-open Publication H8-269481).

In general formulas (1) and/or (2), $R^1$ indicates an alkyl group having 7 to 23 carbons; a linear alkyl group having 9 to 17 carbons is especially preferable. An alkaline metal indicated by X can be Na, K and the like; Na is preferable. A known method for manufacturing an amide amino acid surfactant expressed by general formulas (1) and/or (2) is disclosed in Japanese Laid-open Publication H8-269481. A surfactant expressed by formula (1) is obtained by the following method: first, ring opening of alkyl imidazoline is performed in an alkaline aqueous solution; then, monohalo acetic acid or its salt is added thereto to cause a reaction in an aqueous solvent or sub-alcohol solvent according to a known method. Also, a surfactant expressed by formula (2) can be obtained by adding alkyl imidazoline to a mixture of monohaloacetic acid or its salt and water to cause a reaction while dripping an alkaline aqueous solution into the mixture.

Foaming power can be improved by adding alkaline earth metal ions such as magnesium ions and calcium ions to an amide amino acid surfactant expressed by general formulas (1) and/or (2). The amount of the alkaline earth metal ions to be added is preferably 0.05 to 1 equivalent weight to 1 equivalent weight of the amide amino acid surfactant. When the amount exceeds the above, foaming power is saturated to cause a negative effect on an emulsification stabilizing process.

A surfactant composition, in which alkaline earth metal ions are added to an amide amino acid surfactant expressed by general formulas (1) and/or (2), is commercially available as a shampoo base. The inventor of the present invention discovered that a surfactant composition containing a large amount of salt is not applicable to a fire extinguishing agent used in a low temperature range; therefore, one must select a commercially available product without salt, that is, a salt-free product, such as "Softazoline NS" and "Softazoline SF" (phonetic translations) of the trade name by Kawaken Fine Chemical KK.

<<Test for Low-temperature-resistant Property>>

Low-temperature-resistant properties were studied for foaming power and film forming properties in a low temperature environment (−25° C.) in the case of 0.5 weight % perfluoroalkyl betaine used with 5 weight % amide amino acid surfactant. The range of temperature used herein was −5° C. to below −25° C. A base solution of the fire foam was composed as follows:

| | |
|---|---|
| base fire extinguishing agent | |
| ammonium phosphate: | 15 weight %; |
| solidifying point lowering agent | |
| ethylene glycol | 11 weight %; |
| ethylcellosolve | 3.5 weight %; |
| water | the remainder. |

Foaming power test was performed as follows. 130 ml of the above aqueous solution was placed in a 250 ml SCHOTT DURAN heat-resistant sampling jar. After the temperature of the solution was lowered to −25° C. in a uniform temperature chamber, the sampling jar was shaken to form foam. Then, the height of the foam was measured. The results are shown in Table 1. In the table, symbols indicate as follows: X=no foaming power; Δ=low foaming power (the height of the foam 3 m/m); ○=high foaming power (the height of the foam 10 m/m; ⊙=excellent foam stability (the height of the foam 15 to 20 m/m).

TABLE 1

| Combination | −5° C. | −10° C. | −15° C. | −20° C. | −25° C. | <−25° C. |
|---|---|---|---|---|---|---|
| A + E | ⊙ | ⊙ | ○ | Δ | X | |
| B + E | ⊙ | ⊙ | ⊙ | ⊙ | ⊙ | ○ |
| B + C | ⊙ | ⊙ | ⊙ | ⊙ | ○ | Δ |
| B + D | ⊙ | ⊙ | ⊙ | ⊙ | ○ | Δ |

A = perfluoroalkyl potassium carboxylate salt
B = perfluoroalkyl betaine
C = alkyl carboxy betaine
D = N-acyl-N-methyl-β-alaninate
E = amide amino acid surfactant expressed by formula (1)

As is obvious from the table, a combination of perfluoroalkyl betaine and an amide amino acid surfactant expressed by formula (1) is excellent in low temperature resistant properties, compared to other combinations.

Foaming power is further improved at −25° C. or below by adding 0.1 to 0.5 weight % of one or more of the following as a fluorinated surfactant to the aqueous fire foam of the present invention: perfluoroalkyl potassium sulfonate; perfluoroalkyl potassium carboxylate; and perfluoroalkyl quaternary ammonium iodine.

By adding 2 to 3 weight % of polyoxyethylene sodium alkyl sulfate to the aqueous fire foam of the present invention, interfacial tension can be lowered within a range of temperature at which the fire foam is used (−20° C. to −40° C.); also, heat-resistance and liquid-resistance are improved.

Further, 1 to 2 weight % of dialkyl sodium sulfosuccinate can be added to increase wettability and emulsification in a low temperature range and to lower interfacial tension.

Stability of foam can be remarkably improved by adding 0.5 to 1 weight % of alkanol amide (1:2 type) to the aqueous fire foam of the present invention.

Moreover, the film-forming properties can be improved by adding 0.1 to 5 weight % of PEO amine #6,000 to the aqueous fire foam of the present invention.

One may improve a function to lower surface tension (15 dyn to 17 dyn) and interfacial tension (1.5 dyn to 2.0 dyn) in a low temperature range (−10° C. or below) by adding di-isopropanol amine ($[CH_2CH(OH)CH_2]_2NH$: a compound with high reactiveness having properties of alcohol and amine) to the aqueous fire foam of the present invention. Also, di-isopropanol amine is effective in increasing foam developing properties and helps a foam film to smoothly spread on the surface of burning oil.

Addition of sulfate ester salt, polyoxyethylene sodium (or ammonium) alkyl sulfate, or polyoxyethylene nonylphenyl ether 512 to the aqueous fire foam of the present invention provides strong moisture (wetting)-permeability and emulsification effects and lowers interfacial tension. As a result, a "thixotropic property" is provided to the fire foam; and the emulsification effect promotes generation of a "gelated mat."

Additionally, a sulfate ester salt is highly effective as a condition stabilizing (clarifying) agent of the aqueous fire foam of the present invention. Further, a sulfate ester salt is effective to emulsify oils made of animal, mineral and plant, as well as gas oil, oil fuel, low-viscosity oil, petroleum, gasoline, benzene, toluene and the like. Especially, when it is combined with a fluorinated surfactant or polymer cellulose, high moisture (wetting)-permeability, an emulsification effect, and an effect to lower interfacial tension are provided. Therefore, the emulsification by the "thixotropic property" significantly increases formation of a "gelated mat."

Also, it is preferable to add one or more of the following solvents and 0.1 to 5 weight % polybasic acid to the aqueous fire foam of the present invention to further lower surface and interfacial tension in a low temperature range: alkyl betaine surfactants; isopropyl alcohol; methanol; acetone; methyl ethyl ketone; butoxy ethanol; ethyl cellosolve; butyl carbitol; ethylene glycol; and ethanol.

In addition, stability of the aqueous fire foam can be improved by adding 0.5 to 1.5 weight % of dietary rice vinegar mainly as a fine-foam forming agent.

The following can be added to the aqueous fire foam as a foam stabilizing agent: polyethylene glycol (PEG#20,000); hydroxy propyl cellulose (HPC); polyethylene glycol derivatives; silicone oil; denatured silicone oil; and fluorinated denatured silicone oil.

It is also preferable to add 2 to 5 weight % of one or more of the following to the aqueous fire foam in order to lower the surface tension in a low temperature range and to improve foaming power and film forming properties: silicone oil; naturally-occurring polymer cellulosic derivatives; and polyethylene glycol derivatives.

Further, it is preferable to add various rust preventives to the aqueous fire foam of the present invention.

Moreover, triethanol amine or amino ethyl ethanol amine can be added to the aqueous fire foam of the present invention mainly to improve the liquid-resistant properties.

<<Components Effective on Dietary Oil Fires>>

When an aqueous fire foam, to which one of boron oxide, potassium tetraborate, carbonate, and tripotassium phosphate is added as an alkalinity promoting agent, is sprinkled on burning dietary oil, alkalization of the heated oil progresses; as a result, combustible gas of the dietary oil stops evaporating due to saponification by hydrolysis and film formation. Hence, the oil becomes incombustible such that the fire is extinguished.

Especially, saponification can be accelerated by mixing boron oxide, which is dissolved in a KOH aqueous solution, as a saponificating agent for oil and fats, into the aqueous fire foam of the present invention.

Dietary oil is generally composed of oleic acid, linoleic acid, and linolenic acid. When KOH is added to the mixture of the acids, an alkali salt forming reaction ($CH_2COOH+MOH \rightarrow CH_3CH_3—CH_2COOM+H_2O$) is induced; as a result, an incombustible substance is formed. Then, an increase in the boiling point of salts and a decomposing endothermic reaction provide a cooling effect such that the oil becomes safe without a danger of vapor explosion.

One may add a combination of the following mainly as a saponificating agent for oils and fats in the case of oil fires to the aqueous fire foam of the present invention:

one or more of the following:

sodium silicate; potassium silicate; triammonium phosphate; borate; carbonate; and tripotassium phosphate; and one or more of the following:

triethanol amine or laureate;

diethanol amine laureate; and tetrahydro-1, 4-oxazine.

<<Components Effective to Alcohol Fire>>

In general, if an ordinary fire extinguishing agent or a fire extinguishing agent for petroleum fires is used for an alcohol fire, such as an alcohol, ketone, ester, and amine, a large amount must be used, because a foam is broken as soon as it contacts the alcohol and the burning surface. In the aqueous fire foam of the present invention, sulfate ester salt shows an exceptionally excellent alcohol-resistant property among ordinary hydrocarbon surfactants. However, addition of 2 to 8 weight % of a composition soap of di-isopropanol amine, PEO amine and PEG20000 can provide a significant thixotropic property such that a foam smoothly develops.

PREFERABLE MODE OF THE INVENTION

An aqueous fire foam of the present invention, appropriate as an aqueous fire foam for wood and oil fires, contains the following components (by weight %):

| | |
|---|---|
| 1 Main fire extinguishing agent | |
| monoammonium phosphate | 3 to 5% |
| diammonium phosphate | 5 to 8% |
| potassium tetraborate | 2 to 5% |
| ammonium sulfate | 6 to 9% |
| 2 Solidifing point lowering agent | |
| ethylene glycol | 12 to 20% |
| 3 Foam developing agent | |
| perfluoroalkyl betaine | 0.3 to 1% |
| 4 Foaming agent | |
| composition in which alkaline earth metal ions are added to an amide amino acid surfactant expressed by general formulas (1) and/or (2) | 1.5 to 5% |
| 5 Performance improving agent | |
| di-isopropanol amine | 2 to 4% |

EXAMPLES

The following show preferable examples of compositions (by weight % of original solutions) according to the present invention.

Example 1

For General Fire Extinguisher

| | |
|---|---|
| 1 Main fire extinguishing agent | |
| boron oxide ($B_2O_3$) | 2 |
| ammonium sulfate | 10 |
| 2 Supplementary fire extinguishing agent | |
| phosphorus pentaoxide | 8 |
| 3 Solidifing point lowering agent | |
| ethylene glycol | 18 |
| 4 Foam developing agent | |
| perfluoroalkyl betaine | 0.5 |
| 5 Foaming agent | |
| an amide amino acid surfactant expressed by formula (1) (a surfactant composition, "Softazoline NS" (phonetic translation), manufactured by Kawaken Fine Chemical KK) | 5 |
| 6 Rust preventive | |
| benzotriazole | 0.03 |
| 7 Neutralizer | |
| potassium hydroxide | 4 |
| 8 Water | remainder |

An original fire foam solution of this example indicated: pH of 7.8; specific gravity of 1.13; and solidifying point of −25° C. The original solution can be used for fire of type A, B and C without further processing.

Example 2

For Compact Fire Extinguisher

| | |
|---|---|
| 1 Main fire extinguishing agent | |
| ammonium phosphate | 13 |
| potassium tetraborate | 5 |
| 2 Supplementary fire extinguishing agent | |
| ammonium bromide | 4 |
| 3 Solidifing point lowering agent | |
| ethylene glycol | 10 |
| butyl carbitol | 2 |
| 4 Foam developing agent | |
| perfluoroalkyl betaine | 0.3 |
| 5 Foaming agent | |
| an amide amino acid surfactant expressed by formula (1) (a surfactant composition, "Softazoline NS", phonetic translation of the tradename, manufactured by Kawaken Fine Chemical KK) | 3 |
| 6 Sealing agent | |
| PEO amine | 3 |
| 7 Water | remainder. |

An original fire foam solution of this example indicated: pH of 8.2; specific gravity of 1.135; and solidifying point of −25° C. It can be used for a compact fire extinguisher for household use and portable in a car.

INDUSTRIAL APPLICABILITY OF THE INVENTION

As described above, the present invention relates to an aqueous fire foam containing a main fire extinguishing agent and a solidifying point lowering agent. When one combines an amide amino acid surfactant expressed by general formulas (1) and/or (2) or a surfactant composition containing such an surfactant and alkaline earth metal ions as a hydrocarbon surfactant having various structural formulas with perfluoroalkyl betaine as a fluorinated surfactant, outstanding low-temperature resistance can be obtained; such a combination provides excellent foaming power in a low temperature range (−20° C. or below). The combination of the above surfactants result in a stable property of lowering surface tension and interfacial tension in the low temperature range. Therefore, a high performance aqueous fire foam, which has excellent foaming power and film-foaming properties in the low temperature environment at −20° C. or below, can be manufactured at low costs, hence, it can be supplied to users at a low price.

Also, the kinds of fires, which can be extinguished with the aqueous fire foam of the present invention, are expanded to oil fires and alcohol fires. Further, only a small amount of the aqueous fire foam of the present invention is required to extinguish fires; therefore, use of such a compact fire extinguisher enables extinguishing of wood and oil fires in households.

I claim:

1. An aqueous fire foam which has a solidifying point of −20° C. or below by adding a solidifying point lowering agent to a solution containing at least one of:

potassium hydrogen carbonate;

ammonium phosphate;

ammonium sulfate;

ammonium bromide;

boron oxide; and potassium tetraborate;

wherein said aqueous fire foam, which has excellent foaming power and film-forming properties in a low temperature range, contains:

perfluoroalkyl betaine as a fluorinated surfactant;

an amide amino acid surfactant expressed by general formulas (1) and/or (2) shown below as a hydrocarbon surfactant wherein in said formulas:

$R^1$ is an alkyl group having 7 to 23 carbons, a hydroxy alkyl group, an aralkyl group, or an alkenyl group; and X is an alkali metal or hydrogen atom (1)

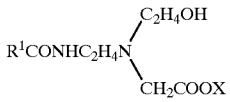

(2)

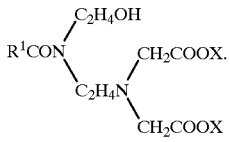

2. An aqueous fire foam according to claim 1 which contains a surfactant composition formed by adding alkaline earth metal ions to an amide amino acid surfactant expressed by general formulas (1) and/or (2).

3. An aqueous fire foam according to claim 2 which contains as a base solution:

0.2 to 0.5 weight % of perfluoroalkyl betaine; and 1.5 to 5 weight % of a surfactant composition containing an amide amino acid surfactant expressed by general formulas (1) and/or (2) and alkaline earth metal ions.

4. An aqueous fire foam according to one of claims 1 through 3 which further contains a performance improving agent.

5. An aqueous fire foam according to one of claims 1 through 3 which contains 2 to 4 weight % of di-isopropanol amine.

6. An aqueous fire foam according to claim 5 into which boron oxide dissolved in a KOH solution is mixed as a saponificating agent for oils and fats.

7. An aqueous fire foam according to claim 5 which contains 0.5 to 1.5 weight % of a dietary rice vinegar.

8. An aqueous fire foam according to claim 5 which further contains a performance improving agent.

9. An aqueous fire foam according to one of claims 1 through 3 into which boron oxide dissolved in a KOH solution is mixed as a saponificating agent for oils and fats.

10. An aqueous fire foam according to claim 9 which contains 0.5 to 1.5 weight % of a dietary rice vinegar.

11. An aqueous fire foam according to claim 9 which further contains a performance improving agent.

12. An aqueous fire foam according to one of claims 1 through 3 which contains 0. 5 to 1.5 weight % of a dietary rice vinegar.

13. An aqueous fire foam according to claim 12 which further contains a performance improving agent.

* * * * *